US006588518B2

(12) United States Patent
Eddison

(10) Patent No.: US 6,588,518 B2
(45) Date of Patent: Jul. 8, 2003

(54) DRILLING METHOD AND MEASUREMENT-WHILE-DRILLING APPARATUS AND SHOCK TOOL

(75) Inventor: Alan Martyn Eddison, Stonehaven (GB)

(73) Assignee: Andergauge Limited, Aberdeen (GB)

( * ) Notice: Subject to any disclaimer, the term of this patent is extended or adjusted under 35 U.S.C. 154(b) by 0 days.

(21) Appl. No.: 09/891,115

(22) Filed: Jun. 25, 2001

(65) Prior Publication Data

US 2002/0050359 A1 May 2, 2002

(30) Foreign Application Priority Data

Jun. 23, 2000 (GB) ..... 0015497

(51) Int. Cl.[7] ..... E21B 4/14

(52) U.S. Cl. ..... 175/296; 175/298; 175/38

(58) Field of Search ..... 175/296, 38, 106, 175/298

(56) References Cited

U.S. PATENT DOCUMENTS

| | | | | | |
|---|---|---|---|---|---|
| 3,307,641 | A | * | 3/1967 | Wiggins | 173/202 |
| 4,535,429 | A | * | 8/1985 | Russell et al. | 175/48 |
| 4,830,122 | A | | 5/1989 | Walter | |
| 4,834,196 | A | * | 5/1989 | Falgout, Sr. | 175/256 |
| 6,053,261 | A | * | 4/2000 | Walter | 175/234 |

FOREIGN PATENT DOCUMENTS

| | | |
|---|---|---|
| EP | 0 333 484 | 9/1989 |
| GB | 2 360 800 | 10/2001 |

OTHER PUBLICATIONS

Copy of UK Patent Office Search Report for Patent Appl. GB 0115305.5 completed Nov. 13, 2001.

* cited by examiner

*Primary Examiner*—David Bagnell
*Assistant Examiner*—Robert D Jones
(74) *Attorney, Agent, or Firm*—Alston & Bird LLP

(57) ABSTRACT

A downhole drilling method comprises producing pressure pulses in drilling fluid using measurement-while-drilling (MWD) apparatus (18) and allowing the pressure pulses to act upon a pressure responsive device (16) to create an impulse force on a portion of the drill string.

11 Claims, 3 Drawing Sheets

DRILLING METHOD AND MEASUREMENT-WHILE-DRILLING APPARATUS AND SHOCK TOOL

FIELD OF THE INVENTION

This invention relates to a drilling method.

BACKGROUND OF THE INVENTION

When drilling bores in earth formations, for example to access a subsurface hydrocarbon reservoir, the drilled bore will often include sections which deviate from the vertical plane; this allows a wide area to be accessed from a single surface site, such as a drilling platform. The drilling of such bores, known as directional drilling, utilises a number of tools, devices and techniques to control the direction in which the bore is drilled. The azimuth and inclination of a bore is determined by a number of techniques, primarily through the use of measurement-while-drilling (MWD) technology, most commonly in the form of an electromechanical device located in the bottomhole assembly (BHA). MWD devices often transmit data to the surface using mud-pulse telemetry. This involves the production of pressure pulses in the drilling fluid being pumped from surface to the drill bit, a feature of the pulses, such as the pulse frequency or amplitude, being dependent on a measured parameter, for example the inclination of the bore. Currently, three main mud-pulse telemetry systems are available: positive-pulse, negative-pulse, and continuous-wave systems. By analysing or decoding the pressure pulses at surface it is possible for an operator to determine the relevant measured bore parameter.

It is among the objectives of embodiments of the present invention to utilise the pressure pulses produced by MWD apparatus for uses in addition to data transfer.

BRIEF SUMMARY OF THE INVENTION

According to one aspect of the present invention there is provided a drilling method comprising:

producing pressure pulses in drilling fluid using measurement-while-drilling (MWD) apparatus; and allowing the pressure pulses to act upon a pressure responsive device to create an impulse force on a portion of the drill string.

The impulse force resulting may be utilised in a variety of ways, including providing a hammer-drilling effect at the drill bit, and vibrating the BHA to reduce friction between the BHA and the bore wall.

The invention also relates to apparatus for implementing the method.

The pressure pulses produced by conventional MWD apparatus are typically up to around 500 psi. At this pressure it may be possible to produce a useful impulse force, however it is preferred that the pressure pulses are in the region of 700–1000 psi. Pressure pulses of this magnitude may be produced by modifying or varying the valving arrangements provided in conventional MWD apparatus, for example by modifying the valving arrangement such that the valve remains closed for a longer period. The greater magnitude of the pressure pulses will also facilitate detection at surface, particularly in situations where there may be relatively high levels of attenuation of the pulses, for example in extended reach bores or in under-balance drilling operations where the drilling fluid column may be aerated. The pressure pulses may be of any appropriate form, including positive pulses, negative pulses, and continuous waves of pulses, as are familiar to those of skill in the art.

The pressure responsive tool may be in the form of a shock tool, typically a tool forming part of a drill string which tends to axially extend or retract in response to changes in internal fluid pressure. The shock tool may be tubular and formed of two telescoping parts, with a spring located therebetween. One of the parts may define a piston, such that a rise in drilling fluid pressure within the tool tends to separate the parts and thus axially extend the tool.

The pressure responsive tool may be located above or below the MWD apparatus, and most preferably is above the MWD apparatus. The optimum location may be determined by the mud-pulse telemetry system being utilised.

BRIEF DESCRIPTION OF THE SEVERAL VIEWS OF THE DRAWINGS

These and other aspects of the invention will now be described, by way of example, with reference to the accompanying drawings, in which.

DETAILED DESCRIPTION OF THE INVENTION

Figure 1:
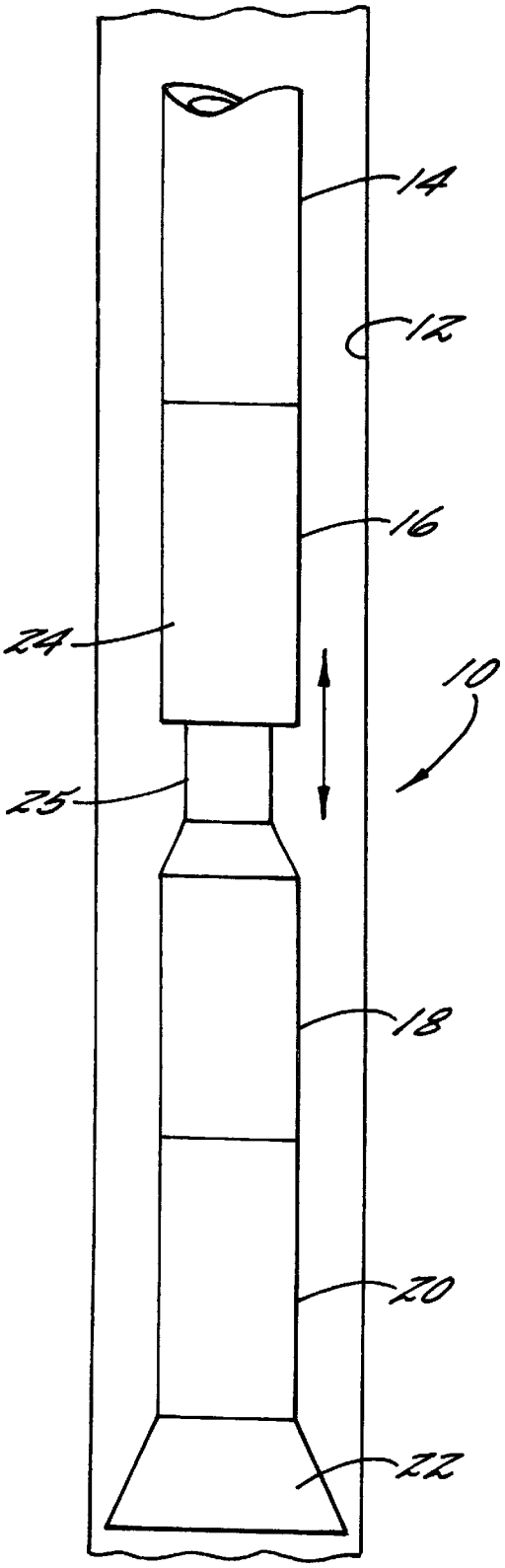
FIG. 1 is a schematic illustration of drilling apparatus in accordance with a preferred embodiment of the present invention.

Reference is first made to FIG. 1 of the drawings, which is a schematic illustration of drilling apparatus 10 in accordance with an embodiment of the present invention, shown located in a drilled bore 12.

The apparatus 10 is shown mounted on the lower end of a drill string 14 and, in this example, comprises a shock tool 16, an MWD tool 18, a downhole motor 20 and a drill bit 22. Of course those of skill in the art will recognise that this is a much simplified representation, and that other tools and devices, such as stabilisers, bent subs and the like will normally also be present.

During a drilling operation, drilling fluid is pumped from surface down through the tubular drill string 14, and the string 14 may be rotated from surface.

Figure 2:
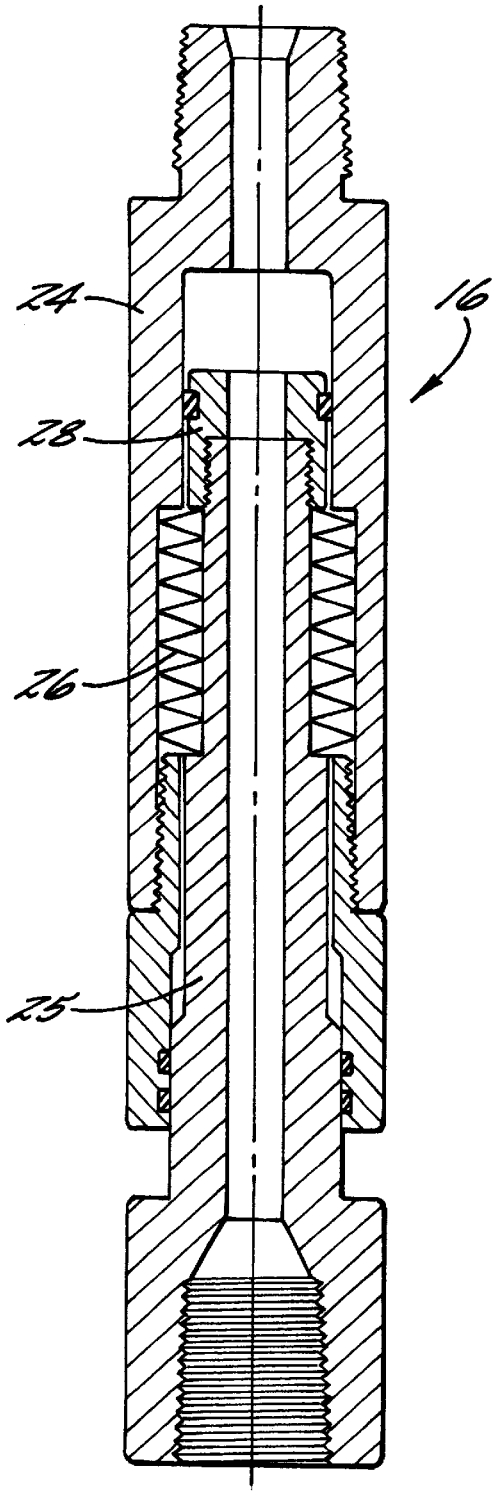
FIG. 2 is a sectional view of a shock tool of the apparatus of FIG. 1.

The shock tool 16, as illustrated in section in FIG. 2 of the drawings, is tubular and is formed of two telescoping parts 24, 25, with a spring 26 located therebetween. One of the parts 25 defines a piston 28, such that a rise in drilling fluid pressure within the tool 16 tends to separate the parts 24, 25 and thus axially extend the tool 16. The internal spring 26, and the weight-on-bit (WOB), tends to restore the tool 16 to a retracted configuration when the drilling fluid pressure falls.

Figure 3:
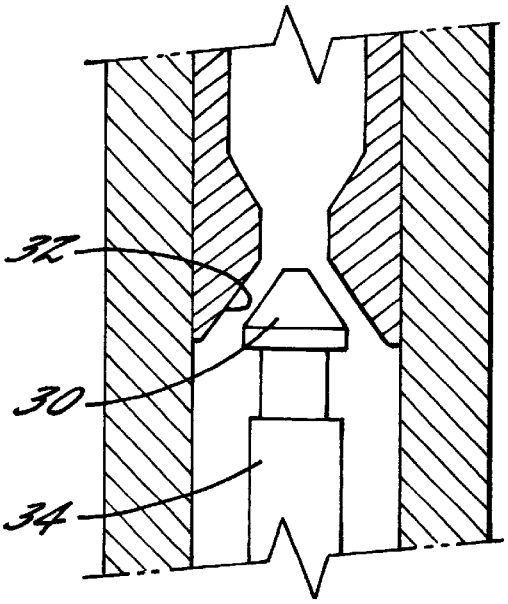
FIGS. 3 and 4 are sectional views of the valve of the MWD apparatus of FIG. 1.
Figure 4:
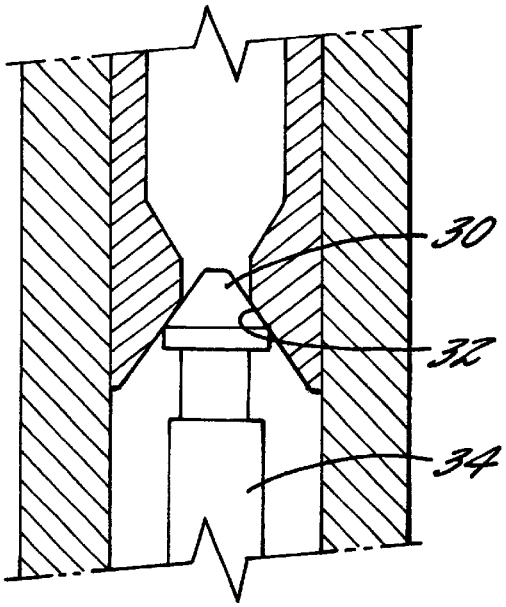

The MWD tool 18 includes various sensors and a motorised valve 30 which opens and closes at a frequency related to the MWD apparatus sensor outputs. FIGS. 3 and 4 of the drawings illustrate the valve 30 in the open and closed positions. In the illustrated example the valve 30 is of a poppet type, and is pushed up onto a seat 32 by an actuator 34 below the valve 30. The opening and closing of the valve 30 produces a variation in the flow area through the tool 18, and thus creates corresponding pressure variations in the drilling fluid. As the valve 30 closes, the pressure of the drilling fluid above the tool 18, including the fluid pressure in the shock tool 16, rises to produce a pressure pulse. By measuring and monitoring the pressure pulses at surface, and by decoding the thus transmitted signal, it is possible to determine the condition being measured or detected by the tool sensors.

The motor 20 is a positive displacement motor (PDM) and is powered by the flow of drilling fluid therethrough. When drilling "straight ahead" the drill string is also driven to rotate the bit 22 from surface, however when the drilling direction is to be varied typically only the motor 20 will drive the bit 22.

In use, the pressure pulses produced by the MWD tool 18 will act on the shock tool 16, causing the tool 16 to expand and retract; this has a number of effects. Firstly, if the magnitude of the pressure pulses is sufficient, the expansion and retraction of the shock tool 16 will produce a percussion or hammer-drill effect on the bit 22, and in certain rock types this will accelerate the rate of advancement of the bit 22. Further, particularly when the bit 22 is being driven only by the motor 20, the vibration of the tool 18, motor 20, and other tools and devices mounted on the string resulting from the extension and retraction of the string tends to reduce the friction between the string elements and the bore wall. This in turn facilitates the advance of the bit 22.

From the above description, it will be apparent to those of skill in the art that the apparatus 10 utilises the data-transmitting signals generated by the MWD tool 18 to facilitate advancement of the bit 22, in addition to carrying information to surface.

Those of skill in the art will also recognise that the above-described embodiment is merely exemplary of the present invention, and that various modifications and improvements may be made thereto, without departing from the scope of the invention. In particular, MWD tools take many different forms, and it should be noted that the illustrated MWD valve arrangement is merely one of a number of possible valves which may be utilised in the present invention.

Figure 5:
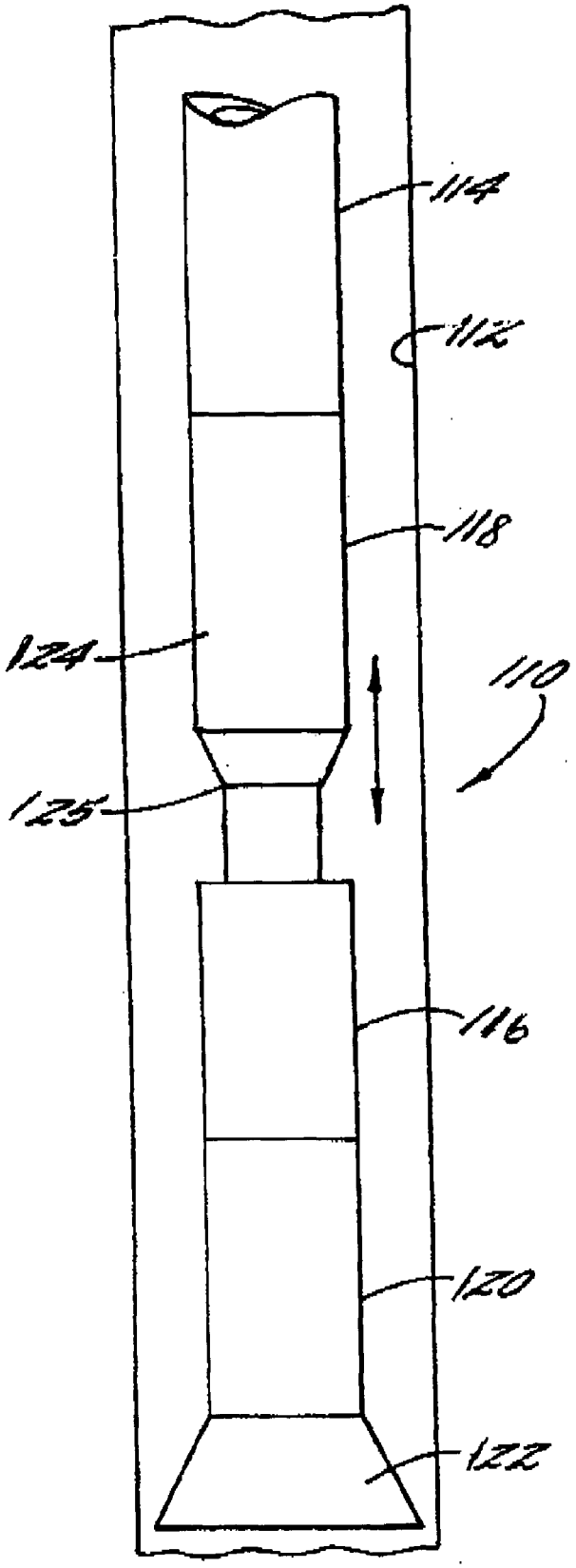
FIG. 5 is a schematic illustration of drilling apparatus in accordance with a further embodiment of the present invention.

Also, a MWD tool 118 may be provided above a shock tool 116, as illustrated in the apparatus 110 of FIG. 5, in which the features common to the apparatus 10 described above are labelled with the same reference numbers, incremented by 100.

What is claimed is:

1. A downhole drilling method comprising:

producing pressure pulses in drilling fluid using measurement-while-drilling (MWD) apparatus in a drill string having a drill bit; and allowing the pressure pulses to act upon a pressure responsive device to create an impulse force on a portion of the drill string, wherein the impulse force is utilized to provide a hammer drilling effect at the drill bit.

2. The method of claim 1, wherein the impulse force is utilised to vibrate a bottomhole assembly (BHA) to reduce friction between the BHA and a bore wall.

3. The method of claim 1 wherein the pulses have an amplitude of up to around 500 psi.

4. The method of claim 1 wherein the pulses have an amplitude of between 700 and 1000 psi.

5. Downhole drilling apparatus for mounting on a drill string having a drill bit, the apparatus comprising:

measurement-while-drilling (MWD) apparatus; and a pressure responsive device operatively associated with the MWD apparatus and responsive to pressure pulses produced by the MWD apparatus to create an impulse force on a portion of the drill string, wherein the impulse force is utilized to provide a hammer drilling effect at the drill bit.

6. The apparatus of claim 5, wherein the pressure responsive device is in the form of a shock tool.

7. The apparatus of claim 6, wherein the shock tool forms part of the drill string and axially extends and retracts in response to changes in internal fluid pressure.

8. The apparatus of claim 7, wherein the shock tool is tubular and comprises of two telescoping parts, with a spring located therebetween.

9. The apparatus of claim 8, wherein one of said parts defines a piston, such that a rise in drilling fluid pressure within the tool tends to separate the parts and thus axially extend the tool.

10. The apparatus of claim 5, wherein the pressure responsive device is located above the MWD apparatus.

11. The apparatus of claim 5, wherein the pressure responsive device is located below the MWD apparatus.

* * * * *

UNITED STATES PATENT AND TRADEMARK OFFICE

CERTIFICATE OF CORRECTION

PATENT NO. : 6,588,518 B2
DATED : July 8, 2003
INVENTOR(S) : Eddison

It is certified that error appears in the above-identified patent and that said Letters Patent is hereby corrected as shown below:

Title page,
Item [56], References Cited, U.S. PATENT DOCUMENTS, "Wiggins" should read -- Wiggins, Jr. --.

Column 4,
Line 12, before "utilised" insert -- further --.

Signed and Sealed this

Seventh Day of October, 2003

JAMES E. ROGAN
*Director of the United States Patent and Trademark Office*